US009603417B2

(12) United States Patent
Arevalo

(10) Patent No.: US 9,603,417 B2
(45) Date of Patent: Mar. 28, 2017

(54) TIELESS FOOTWEAR LACING SYSTEM, APPARATUSES, AND METHODS OF USING THE SAME

(71) Applicant: Alvaro L. Arevalo, Vacaville, CA (US)

(72) Inventor: Alvaro L. Arevalo, Vacaville, CA (US)

( * ) Notice: Subject to any disclaimer, the term of this patent is extended or adjusted under 35 U.S.C. 154(b) by 95 days.

(21) Appl. No.: 14/703,798

(22) Filed: May 4, 2015

(65) Prior Publication Data

US 2016/0324267 A1 Nov. 10, 2016

(51) Int. Cl.
*A43C 1/00* (2006.01)
*A43C 5/00* (2006.01)

(52) U.S. Cl.
CPC ..... *A43C 1/00* (2013.01); *A43C 5/00* (2013.01); *Y10T 24/3726* (2015.01)

(58) Field of Classification Search
CPC ..... A43C 1/00; A43C 5/00; A43C 11/1493; A43C 11/008; A43C 11/14; A43C 11/004; A43C 11/006; A43C 11/22; A43C 15/12; A43C 19/00; A43B 7/14; A43B 7/1495
USPC ..... 24/306
See application file for complete search history.

(56) References Cited

U.S. PATENT DOCUMENTS 1,504,157 A * 8/1924 Sowers ..... A43C 9/00 24/712
3,193,950 A * 7/1965 Liou ..... A43C 11/004 24/713.9
4,079,527 A * 3/1978 Antonious ..... A43C 11/1493 36/50.1
4,282,657 A * 8/1981 Antonious ..... A43B 5/00 24/306
4,411,077 A * 10/1983 Slavitt ..... A43B 5/00 36/114
4,441,265 A * 4/1984 Burns ..... A43B 7/20 36/114
4,476,639 A * 10/1984 Zaccaria ..... A43B 5/00 36/114
4,547,981 A * 10/1985 Thais ..... A43B 7/00 36/114
4,621,648 A * 11/1986 Ivany ..... A43B 5/00 36/89
4,640,025 A * 2/1987 DeRenzo ..... A43C 11/1493 36/114
4,654,985 A 4/1987 Chalmers
(Continued)

*Primary Examiner* — Robert J Sandy
*Assistant Examiner* — Rowland Do
(74) *Attorney, Agent, or Firm* — Patentfile, LLC; Bradley C. Fach; Steven R. Kick

(57) ABSTRACT

A footwear lace securing system which in some embodiments may comprise a first tension strap apparatus having a first elongate strap body with a first medial end, a first distal end, and first tension strap fastener. The first medial end may be coupled to a shoe lace between two shoe eyelets. The system may also comprise a second tension strap apparatus having a second elongate strap body with a second medial end, a second distal end, and a second tension strap fastener. The second medial end may be coupled to a shoe lace between two shoe eyelets opposite to the first elongate strap body. The first and second tension strap apparatuses may each be configured to wrap around the upper and sole portions of the article of footwear in opposing directions and may be secured to one another by coupling the first and second tension strap fasteners together.

19 Claims, 11 Drawing Sheets

(56) References Cited

U.S. PATENT DOCUMENTS

RE32,585 E * 2/1988 Antonious ..... A43C 11/1493 24/306
4,972,609 A * 11/1990 Oh ..... A43B 5/00 36/114
5,269,078 A * 12/1993 Cochrane ..... A43B 5/00 36/170
5,335,400 A 8/1994 Sales
5,400,529 A * 3/1995 Bell ..... A43B 5/00 36/114
5,471,769 A * 12/1995 Sink ..... A43B 11/00 24/712.1
5,557,864 A * 9/1996 Marks ..... A43C 11/00 24/306
5,659,982 A * 8/1997 Muraoka ..... A43B 3/0073 36/131
5,704,140 A * 1/1998 Fields ..... A43B 7/20 36/132
5,794,360 A * 8/1998 Bell ..... A43C 11/1493 24/306
5,819,439 A * 10/1998 Sanchez ..... A43B 5/00 36/50.1
5,839,210 A 11/1998 Bernier et al.
5,943,792 A * 8/1999 Powell ..... A43C 15/06 15/227
6,128,835 A * 10/2000 Ritter ..... A43C 1/00 36/114
6,270,468 B1 * 8/2001 Townsend ..... A43B 5/10 36/114
6,272,772 B1 * 8/2001 Sherman ..... A43B 5/16 36/89
6,327,750 B1 * 12/2001 Muldowney ..... A43C 1/00 24/68 SK
6,467,195 B2 10/2002 Pierre et al.
6,505,424 B2 * 1/2003 Oorei ..... A43B 5/00 36/129
6,692,454 B1 * 2/2004 Townsend ..... A43B 5/10 128/882
6,779,280 B2 * 8/2004 Wright ..... A43B 1/0081 36/114
D514,788 S * 2/2006 Schoenborn ..... D2/969
7,073,279 B2 * 7/2006 Min ..... A43C 1/003 24/712
7,591,050 B2 9/2009 Hammerslag
7,818,899 B2 10/2010 Dinndorf et al.
7,841,106 B2 * 11/2010 Farys ..... A43C 1/04 24/712.2
8,353,088 B2 1/2013 Ha
8,533,978 B2 * 9/2013 Volin ..... A43B 3/0078 24/712.2
8,756,833 B2 * 6/2014 Heard ..... A43C 1/04 24/714.7
8,857,077 B2 * 10/2014 Kahatsu ..... A43B 3/26 36/113
9,402,437 B2 * 8/2016 Berns ..... A43B 3/0063
2002/0088144 A1 * 7/2002 Katz ..... A43C 11/14 36/88
2003/0167655 A1 * 9/2003 Sussmann ..... A43C 11/008 36/50.1
2006/0053658 A1 * 3/2006 Voughlohn ..... A43C 1/00 36/50.1
2008/0066344 A1 * 3/2008 Kelley ..... A43C 11/1493 36/50.1
2008/0086910 A1 * 4/2008 Kim ..... A43C 11/1493 36/50.1
2008/0244928 A1 * 10/2008 Romboli ..... A43C 11/1493 36/50.1
2009/0300947 A1 * 12/2009 Babolat ..... A43B 7/20 36/114
2011/0010965 A1 * 1/2011 Shepherd ..... A43B 5/00 36/114
2013/0255105 A1 * 10/2013 Bishop ..... A43B 3/126 36/88
2014/0041259 A1 * 2/2014 Oouchi ..... A43C 11/1493 36/131
2014/0338223 A1 * 11/2014 Adams ..... A43C 11/14 36/50.1
2015/0026937 A1 * 1/2015 Nonogawa ..... A43C 1/00 24/713.4
2016/0270484 A1 * 9/2016 Zadnik ..... A43B 23/0205
2016/0309844 A1 * 10/2016 Smith ..... A43B 3/126

* cited by examiner

TIELESS FOOTWEAR LACING SYSTEM, APPARATUSES, AND METHODS OF USING THE SAME

FIELD OF THE INVENTION

This patent specification relates to the field of footwear. More specifically, this patent specification relates to lacing systems for shoes and other foot wear that may be secured or tightened without tying the laces.

BACKGROUND

Foot wear, such as shoes, boots, and the like commonly use conventional shoe laces to secure the foot wear to the foot of an individual. A drawback associated with conventional laces is that it is often difficult to maintain tension on the lace, as the wearer must check and tighten the lace from each of the many eyelets through which the laces are threaded and then tie the laces into a knot. Maintaining desired tension can also be hindered by the friction between the lace and the eyelets. Consequently, the user must often tighten the lace individually through each of the eyelets before tying. This is especially tedious if the number of eyelets is high, such as in running shoes or cleats and other specialized high performance footwear.

Another drawback associated with conventional laces is that they frequently become untied and loose from the shoe during use. This can be troublesome in everyday scenarios, but is dangerous to the point of injury in athletic activities. An individual or another player can step on the loose show laces causing falls and painful injuries. This problem is especially prevalent with young athletes which may not be skilled at tying their laces or may not fully understand their importance.

Therefore, a need exists for novel tightening systems for footwear. There is a further need novel lacing systems for footwear that may be tightened without requiring tying of the laces. Finally, there exists a need for novel tieless footwear lacing systems that are able to maintain desired tension on the laces during a wide variety of athletic activities.

BRIEF SUMMARY OF THE INVENTION

A footwear lace securing system for use with an article of footwear, such as a shoe, boot, and the like is provided. In some embodiments, the system may comprise a first tension strap apparatus having a first elongate strap body with a first medial end, a first distal end, and first tension strap fastener. The first medial end may be coupled to a shoe lace of an article of footwear, such as to a first lace loop formed by a first portion of a shoe lace located between two shoe eyelets. The system may also comprise a second tension strap apparatus having a second elongate strap body with a second medial end, a second distal end, and a second tension strap fastener. The second medial end may be coupled to a shoe lace of an article of footwear, such as to a second lace loop formed by a second portion of a shoe lace located between two shoe eyelets which may be located opposite to the first portion of a shoe lace. The first and second tension strap apparatuses may each comprise a tension strap fastener, and may each be configured to wrap around the upper and sole portions of the article of footwear in opposing directions and may be secured to one another by coupling the tension strap fasteners together.

According to one aspect consistent with the principles of the invention, a method of securing an article of footwear comprising four eyelets and a shoelace, the method comprising the steps of: securing a first tension strap apparatus to the shoelace between two eyelets and securing a second tension strap apparatus to the shoelace between two eyelets on the article of footwear; coupling shoe lace bodies of the shoelace together with a lace fastener; wrapping the first and second tensioning strap apparatuses around the article of footwear; and securing the first and second tension strap apparatuses together with a strap fastener element.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
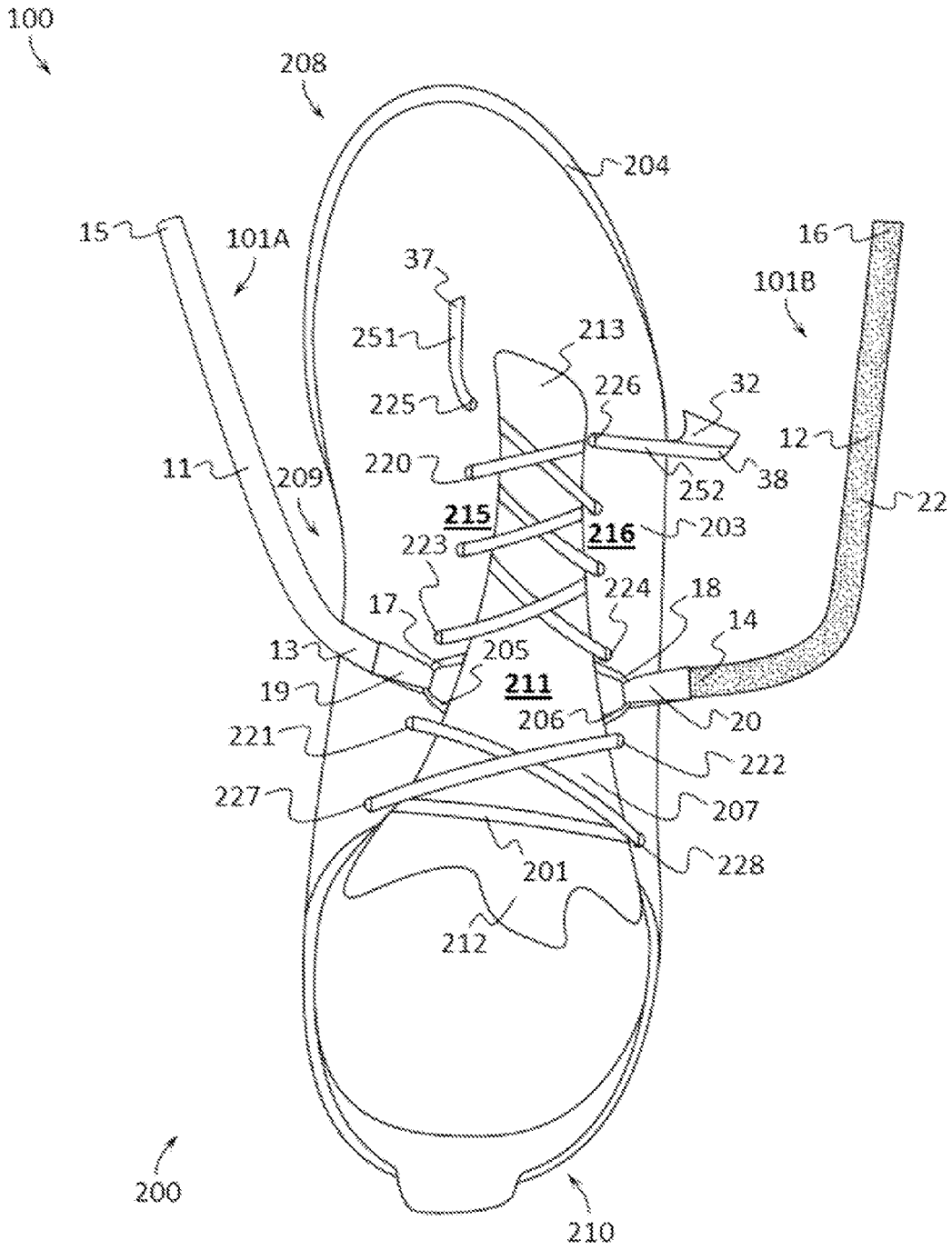
FIG. 1 depicts a top plan view of an example of a tieless footwear lacing system, prior to being tensioned, on an article of footwear according to various embodiments described herein.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

New tieless footwear lacing systems, apparatuses, and methods of using the same are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIGS. 1-5 illustrate an example of a footwear lace securing system ("the system") 100 for use with an article of footwear 200, such as a shoe, boot, and the like. The system 100 may comprise a first tension strap apparatus 101A having a first elongate strap body 11 with a first medial end 13 and a first distal end 15. The first medial end 13 may be coupled to a shoe lace 201 of an article of footwear 200, such as to a first lace loop 17 formed by a first portion of a shoe lace 205 located between two shoe eyelets 220. The system 100 may also comprise a second tension strap apparatus 101B having a second elongate strap body 12 with a second medial end 14 and a second distal end 16. The second medial end 14 may be coupled to a shoe lace 201 of an article of footwear 200, such as to a second lace loop 18 formed by a second portion of a shoe lace 206 located between two shoe eyelets 220 which may be located opposite to the first portion of a shoe lace 205. In this and some embodiments, both the first 101A and second 101B tension straps may be configured to wrap around the upper 203 and sole portions 204 of the article of footwear 200 in opposing directions and may be secured to one another.

Figure 6:
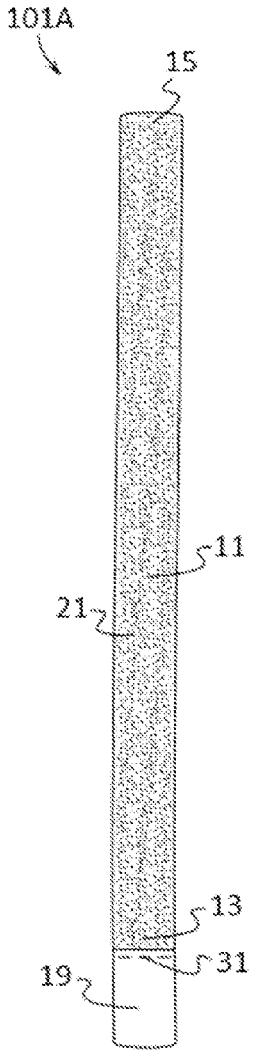
FIG. 6 shows a plan view of a first side of an example of a first tensioning strap apparatus according to various embodiments described herein.
Figure 7:
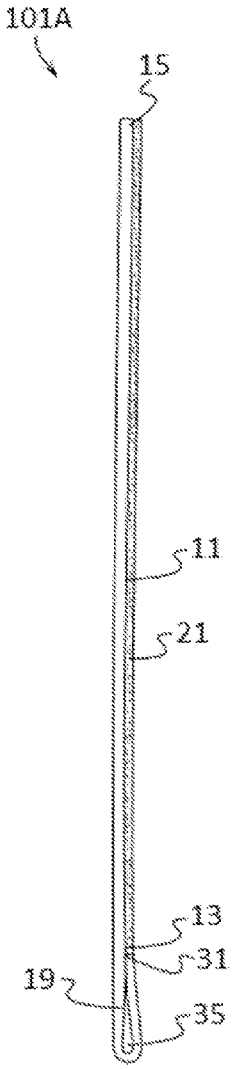
FIG. 7 depicts an elevation view of an example of a first tensioning strap apparatus according to various embodiments described herein.
Figure 8:
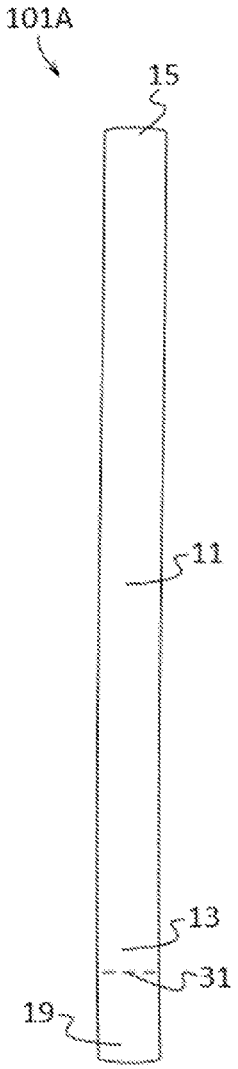
FIG. 8 illustrates a plan view of a second side of an example of a first tensioning strap apparatus according to various embodiments described herein.

Turning now to FIGS. 6-8, an example of a first tensioning strap apparatus 101A according to various embodiments described herein is illustrated. In some embodiments, a first tensioning strap apparatus 101A may comprise a first elongate strap body 11 which may be made from flexible synthetic materials and fibers such as nylon webbing, polypropylene webbing, polyester webbing, neoprene foam rubber, polyester fabrics, rayon fabrics, and from flexible natural materials and fibers such as cotton webbing, flax webbing, other fabrics, such as flax, coir, cotton, hemp, jute, leather, linen, ramie, wool, silk or any other type of flexible natural or synthetic fibers or materials including combinations of materials.

The first elongate strap body 11 may comprise a first medial end 13 and a first distal end 15 both of which may be oppositely located on the first elongate strap body 11. The first medial end 13 may be configured to be coupled to a shoe lace 201 (FIGS. 1, 2, 3, 12-14) such as to a first portion of a shoe lace 205 (FIGS. 1, 2, 3, 12-14) on an article of footwear 200 (FIGS. 1, 2, 3, 12-14). In some embodiments, the first medial end 13 may comprise or be coupled to a first lace securing element 19. In further embodiments, a first lace securing element 19 may be formed by a portion of the first medial end 13 which has been folded back upon itself and then coupled to itself, such as with stitching 31, heat bonding, adhesive, and the like, to form a loop or channel 35 through which a first portion of a shoe lace 205 may be passed through, thereby coupling the first medial end 13 to a first portion of a shoe lace 205. In other embodiments, a first lace securing element 19 may comprise a hook type fastener, clamp type fastener, hook and loop type or Velcro® fastener, clasp type fastener, carbineer type fastener, or any other fastener suitable for receiving a first portion of a shoe lace 205 or for securing a first portion of a shoe lace 205, thereby coupling the first medial end 13 to a first portion of a shoe lace 205. In still other embodiments, a first lace securing element 19 may be formed by a portion of the first medial end 13 which has been folded back upon itself and then coupled to itself, such as by being tied or knotted to form a loop or channel through which a first portion of a shoe lace 205 may be passed through, thereby coupling the first medial end 13 to a first portion of a shoe lace 205.

The first elongate strap body 11 may comprise one or more tension strap fasteners such as a first tension strap fastener 21. A first tension strap fastener 21 may be positioned anywhere on the first elongate strap body 11 such as on or proximate the first distal end 15. A first tension strap fastener 21 may be configured to removably couple to itself and/or to another tension strap fastener, such as to a second tension strap fastener 22 (FIGS. 9-11), thereby securing the first and second tension strap apparatuses 101A, 101B, to one another. In some embodiments, a first tension strap fastener 21 may comprise a hook and loop type or Velcro® fastener, magnetic type fastener, threaded type fastener, sealable tongue and groove fastener, snap fastener, strap type fastener, buckle type fastener such as a belt or watch buckle type fastener, clip type fastener, clasp type fastener, ratchet type fastener, a push-to-lock type connection method, a turn-to-lock type connection method, slide-to-lock type connection method or any other suitable temporary or removable connection method as one reasonably skilled in the art could envision to serve the same function.

Figure 9:
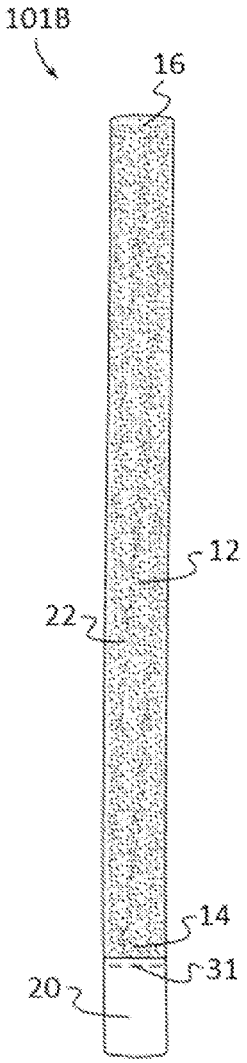
FIG. 9 shows a plan view of a first side of an example of a second tensioning strap apparatus according to various embodiments described herein.
Figure 10:
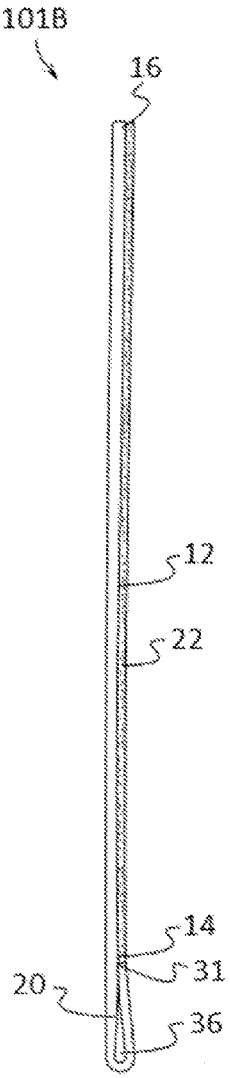
FIG. 10 depicts an elevation view of an example of a second tensioning strap apparatus according to various embodiments described herein.
Figure 11:
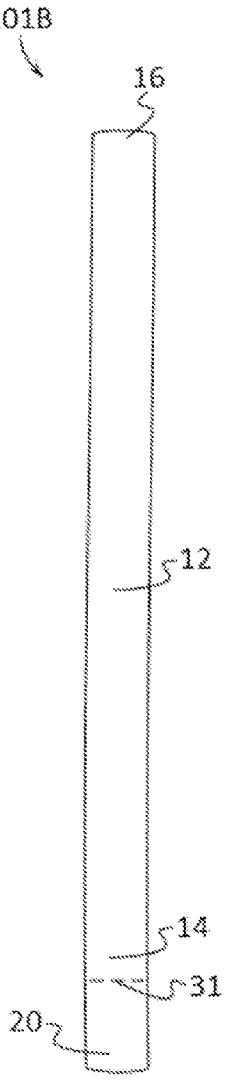
FIG. 11 illustrates a plan view of a second side of an example of a second tensioning strap apparatus according to various embodiments described herein.

Turning now to FIGS. 9-11, an example of a second tensioning strap apparatus 101B according to various embodiments described herein is shown. In some embodiments, a second tensioning strap apparatus 101 B may comprise a second elongate strap body 12 which may be made from flexible synthetic materials and fibers such as nylon webbing, polypropylene webbing, polyester webbing, neoprene foam rubber, polyester fabrics, rayon fabrics, and from flexible natural materials and fibers such as cotton webbing, flax webbing, other fabrics, such as flax, coir, cotton, hemp, jute, leather, linen, ramie, wool, silk or any other type of flexible natural or synthetic fibers or materials including combinations of materials.

The second elongate strap body 12 may comprise a second medial end 14 and a second distal end 16 both of which may be oppositely located on the second elongate strap body 12. The second medial end 14 may be configured to be coupled to a shoe lace 201 (FIGS. 1, 2, 3, 12-14) such as to a second portion of a shoe lace 206 (FIGS. 1, 2, 3, 12-14) on an article of footwear 200 (FIGS. 1-7, 13). In some embodiments, the second medial end 14 may comprise or be coupled to a second lace securing element 20. In further embodiments, a second lace securing element 20 may be formed by a portion of the second medial end 14 which has been folded back upon itself and then coupled to itself, such as with stitching 31, heat bonding, adhesive, and the like, to form a loop or channel 36 through which a second portion of a shoe lace 206 may be passed through, thereby coupling the second medial end 14 to a second portion of a shoe lace 206. In other embodiments, a second lace securing element 20 may comprise a hook type fastener, clamp type fastener, hook and loop type or Velcro® fastener, clasp type fastener, carbineer type fastener, or any other fastener suitable for receiving a second portion of a shoe lace 206 or suitable for securing a second portion of a shoe lace 206, thereby coupling the second medial end 14 to a second portion of a shoe lace 206. In still other embodiments, a second lace securing element 20 may be formed by a portion of the medial end 14 which has been folded back upon itself and then coupled to itself, such as by being tied or knotted to form a loop or channel through which a second portion of a shoe lace 206 may be passed through, thereby coupling the second medial end 14 to a second portion of a shoe lace 206.

The second elongate strap body 12 may comprise one or more tension strap fasteners such as a second tension strap fastener 22. A second tension strap fastener 22 may be positioned anywhere on the second elongate strap body 12 such as on or proximate the second distal end 16. A second tension strap fastener 22 may be configured to removably couple to itself and/or to another tension strap fastener, such as a first tension strap fastener 21 (FIGS. 6-8), thereby securing the first and second tension strap apparatuses 101A, 101B, to one another. In some embodiments, a second tension strap fastener 22 may comprise a hook and loop type or Velcro® fastener, magnetic type fastener, threaded type fastener, sealable tongue and groove fastener, snap fastener, buckle type fastener such as a belt or watch buckle type fastener, clip type fastener, clasp type fastener, ratchet type fastener, a push-to-lock type connection method, a turn-to-lock type connection method, slide-to-lock type connection method or any other suitable temporary or removable connection method as one reasonably skilled in the art could envision to serve the same function.

Referring now to FIG. 1 a top plan view of an example of a tieless footwear lacing system 100, prior to being tensioned, on an article of footwear 200 according to various embodiments described herein is depicted. In some embodiments, the system 100 may comprise a shoe lace 201 which may be substituted for the shoe lace of the article of footwear 200 and which may be made of a non-woven material such as polyester or incorporate various other synthetic fibers, which are generally more slippery than those made from traditional fibers allowing the shoe lace 201 to easily slide through the eyelets 220 during tensioning. In other embodiments, the system 100 may be used with a shoe lace 201 which has been provided by the article of footwear 200. Generally, a shoelace 201 may comprise a first lace body 251 and a second lace body 252 which may be likened to two halves of a shoe lace 201 each terminating at a free end 37, 38, of the shoe lace 201. The first lace body 251 may be threaded through a set of eyelets 220 including from a first top eyelet 227 to a first bottom eyelet 225 and the second lace body 252 may be threaded through a set of eyelets 200 including from a second top eyelet 228 to a second bottom eyelet 226. By tensioning the first lace body 251 and the second lace body 252, the shoe lace 201 may be tightened.

In some embodiments, the first lace body 251 and the second lace body 252 may be coupled together to facilitate tensioning of the shoe lace 201. Once the shoe lace 201 has been laced through the eyelets 220 of the article of footwear 200 and through the channels 35, 36, of the tension strap apparatuses 101A, 101B, the first lace body 251 may be coupled to the second lace body 252 at a position proximate to the lower eyelets 225, 226, which may be the bottom eyelets 225, 226, closest to the toe 208 of the article of footwear 200. In other embodiments, the first lace body 251 may be coupled to the second lace body 252 at a position proximate to the upper eyelets 225, 226, which may be the eyelets 220 furthest from the toe 208 of the article of footwear 200. In still other embodiments, the first lace body 251 may be coupled to the second lace body 252 at a position anywhere from the upper eyelets 225, 226, to the bottom eyelets 225, 226, which may be between any eyelets 220 of the article of footwear 200.

Figure 12:
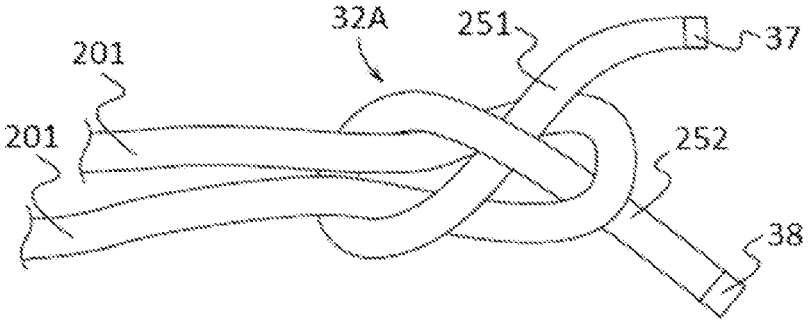
FIG. 12 shows a perspective view of an example of a lace fastener of a tieless footwear lacing system according to various embodiments described herein.
Figure 13:
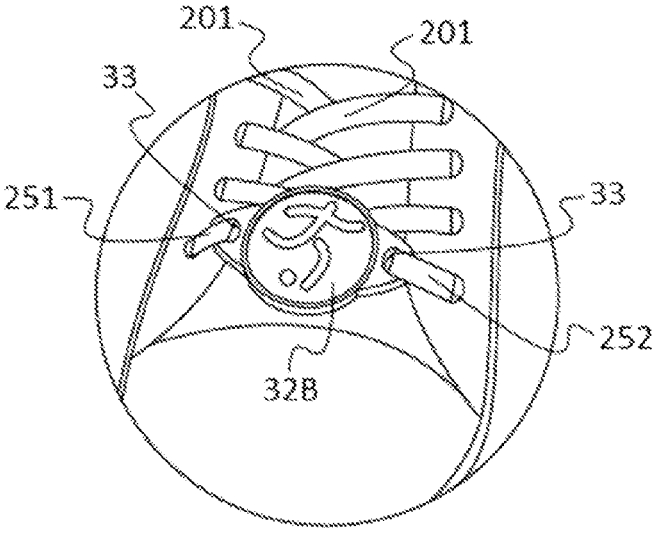
FIG. 13 depicts a perspective view of an example of a lace fastener of a tieless footwear lacing system securing a first lace body to a second lace body on an article of footwear according to various embodiments described herein.
Figure 14:
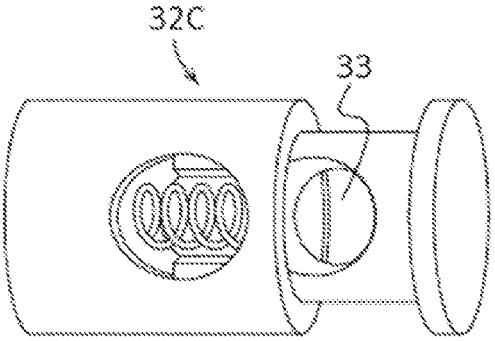
FIG. 14 illustrates a perspective view of an example of a lace fastener of a tieless footwear lacing system according to various embodiments described herein.

The first lace body 251 may be coupled to the second lace body 252 with a lace fastener 32 as shown in FIGS. 2-4 and 12-14. In some embodiments, the first lace body 251 and/or the second lace body 252 may comprise or be coupled to a lace fastener 32. In further embodiments, a lace fastener 32 may be formed by a portion of the first lace body 251 and/or the second lace body 252 which has been coupled the other lace body 251, 252, such as with stitching, heat bonding, adhesive, and the like, thereby coupling the first lace body 251 to the second lace body 252. In other embodiments, a lace fastener 32A may be formed by a portion of the first lace body 251 and/or the second lace body 252 which has been coupled to the other lace body 251, 252, such as by being tied or knotted together, thereby coupling the first lace body 251 to the second lace body 252 with a knot type lace fastener 32A as shown in FIG. 12. In still other embodiments, a lace fastener 32 may be formed by a buckle type lace fastener 32B which may comprise one or more lace fastener apertures 33. A portion of the first lace body 251 and the second lace body 252 may be inserted through a lace fastener aperture 33, folded back upon itself, and then coupled to itself, such as by being tied or knotted to prevent the first lace body 251 and/or the second lace body 252 from pulling through a lace fastener aperture 33 and therefore an eyelet 220 upon tensioning of the shoe lace 201 as depicted in FIG. 13. In still other embodiments, a lace fastener 32 may comprise a clamp type fastener 32C (FIG. 14). A portion of the first lace body 251 and the second lace body 252 may be inserted through a lace fastener aperture 33, folded back upon itself, and then coupled to itself, such as by being tied or knotted to prevent the first lace body 251 and/or the second lace body 252 from pulling through the lace fastener aperture 33 and therefore an eyelet 220 upon tensioning of the shoe lace 201 as depicted in FIG. 14. In still other embodiments, a lace fastener 32 may comprise a hook type fastener, hook and loop type or Velcro® fastener, clasp type fastener, carbineer type fastener, or any other fastener suitable for coupling the first lace body 251 to the second lace body 252.

Figure 2:
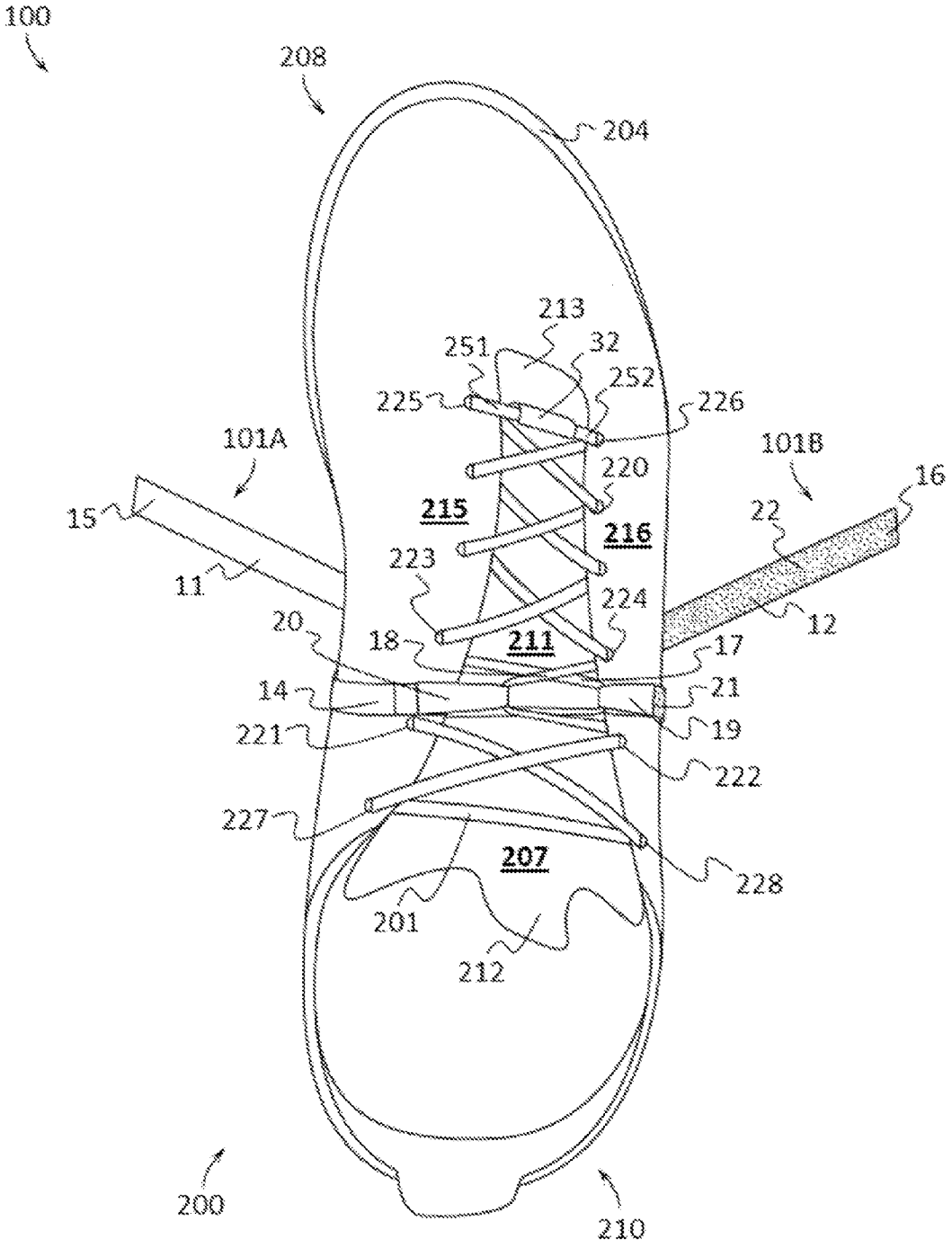
FIG. 2 illustrates a top plan view of an example of a tieless footwear lacing system, during tensioning, on an article of footwear according to various embodiments described herein.
Figure 3:
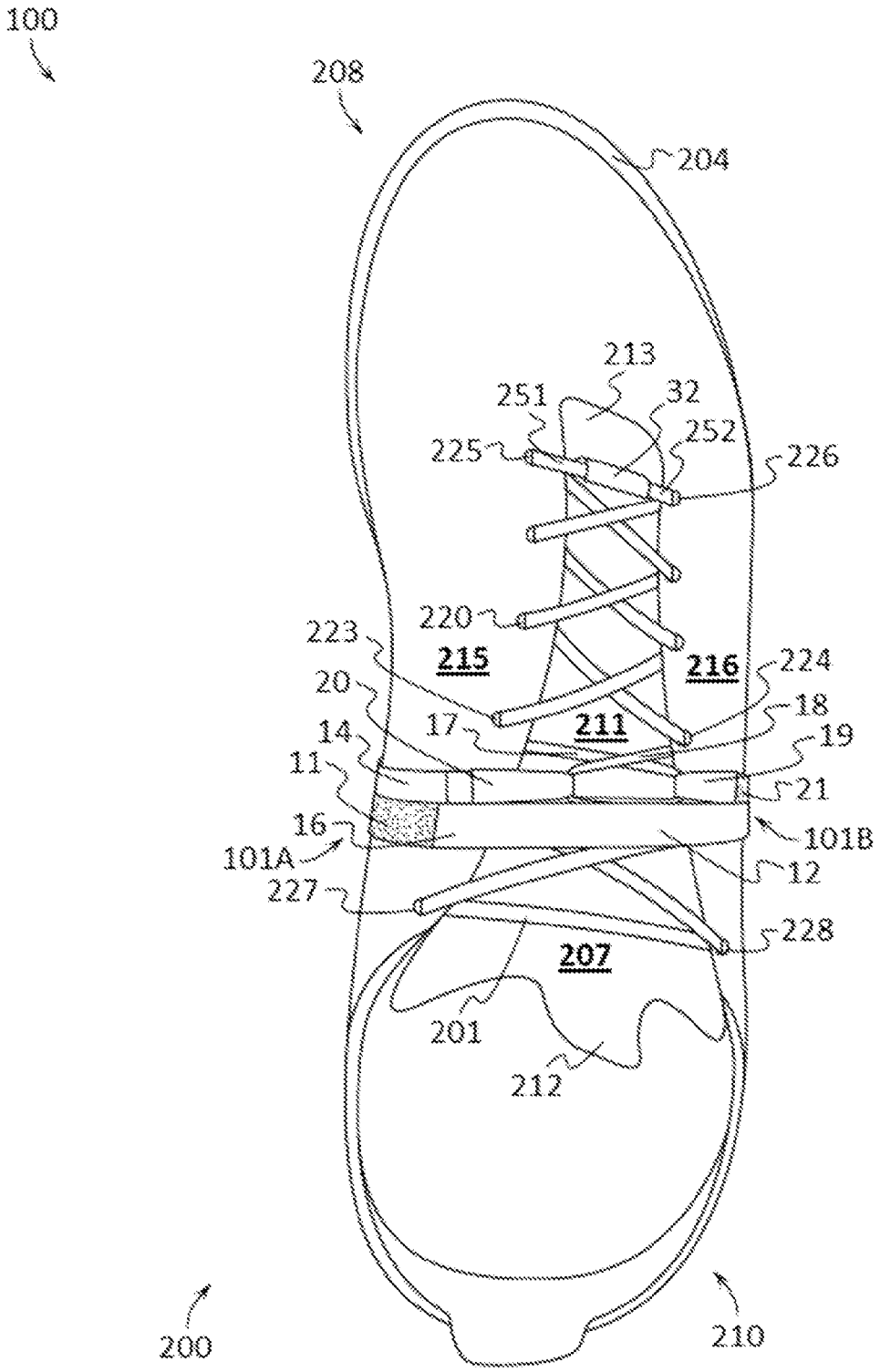
FIG. 3 shows a top plan view of an example of a tensioned tieless footwear lacing system on an article of footwear according to various embodiments described herein.

As shown in FIGS. 1-3, the first and second tension straps 101A, 101B, may be coupled to a shoe lace 201 at adjacent locations at opposite sides of a shoe tongue 207 below a set of top eyelets 227, 228, and above a set of bottom eyelets 225, 226. In some embodiments, the first medial end 13 of the first tension strap apparatus 101A may be coupled to a first lace loop 17 with a first lace securing element 19 and the second medial end 14 of the second tension strap apparatus 101B may be coupled to a second lace loop 18 with a second lace securing element 20. A first lace loop 17, may be formed by a first portion of a shoe lace 205 located between two shoe eyelets 202 on the same side of a shoe tongue 207 and a second lace loop 18, may be formed by a second portion of a shoe lace 206 located between two shoe eyelets 202 on the same side of a shoe tongue 207. Once the first lace body 251 comprising the first portion of a shoe lace 205 and the second lace body 252 comprising the second portion of a shoe lace 206 have been laced through the eyelets 220 and laced through or otherwise coupled to the lace securing elements 19, 20, the first lace body 251 may be coupled to the second lace body 252, such as at a position proximate to the bottom eyelets 225, 226, with a lace fastener 32 as shown in FIGS. 2-4.

In reference to FIG. 2, once the first lace body 251 has been coupled to the second lace body 252, such as with a lace fastener 32, the tension strap apparatuses 101A, 101B, may be drawn to opposing sides of the article of footwear 200 and then wrapped around the upper portion 203 and sole portion 204 of the article of footwear 200 in opposing directions. Optionally, one of the tension strap apparatuses 101A, 101B, may be drawn through the lace loop 17, 18, of the other tension strap apparatus 101A, 101B. In further embodiments, the first and second tension straps 101A, 101B, may be wrapped around the article of footwear 200 at a position proximate to the midsole region 209, such as between the toe 208 and the heel 210 regions of the sole portion 204 as shown in FIGS. 2-5. The first and second tension straps 101A, 101B, may similarly be wrapped around the mid tongue region 211 below the top 212 and bottom 213 of the tongue 207 of the article of footwear 200 at a position proximate to the midsole region 209, such as around the first 215 and second 216 side of the upper portion 203. In further embodiments, the first and second tension straps 101A, 101B, may be wrapped around the mid tongue region 211, around the first 215 and second 216 side of the upper portion 203, and around portions of the exterior lower sole 217 of the sole portion 204 of the article of footwear 200. The exterior lower sole 217 may comprise portions of the sole portion 204, such as between the toe 208 and the heel 210 that are configured to contact the ground.

Figure 4:
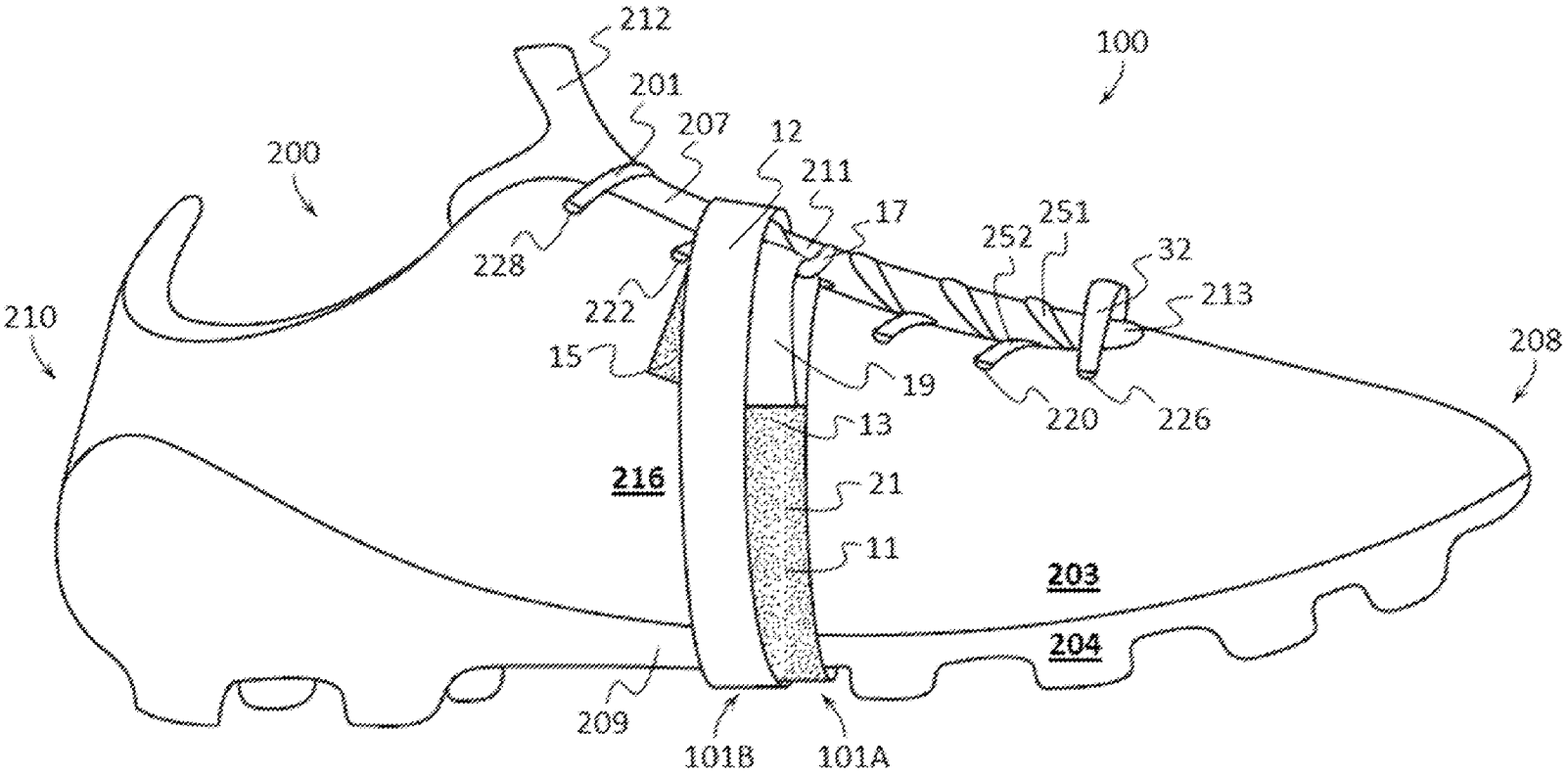
FIG. 4 depicts a side elevation view of an example of a tensioned tieless footwear lacing system on an article of footwear according to various embodiments described herein.
Figure 5:
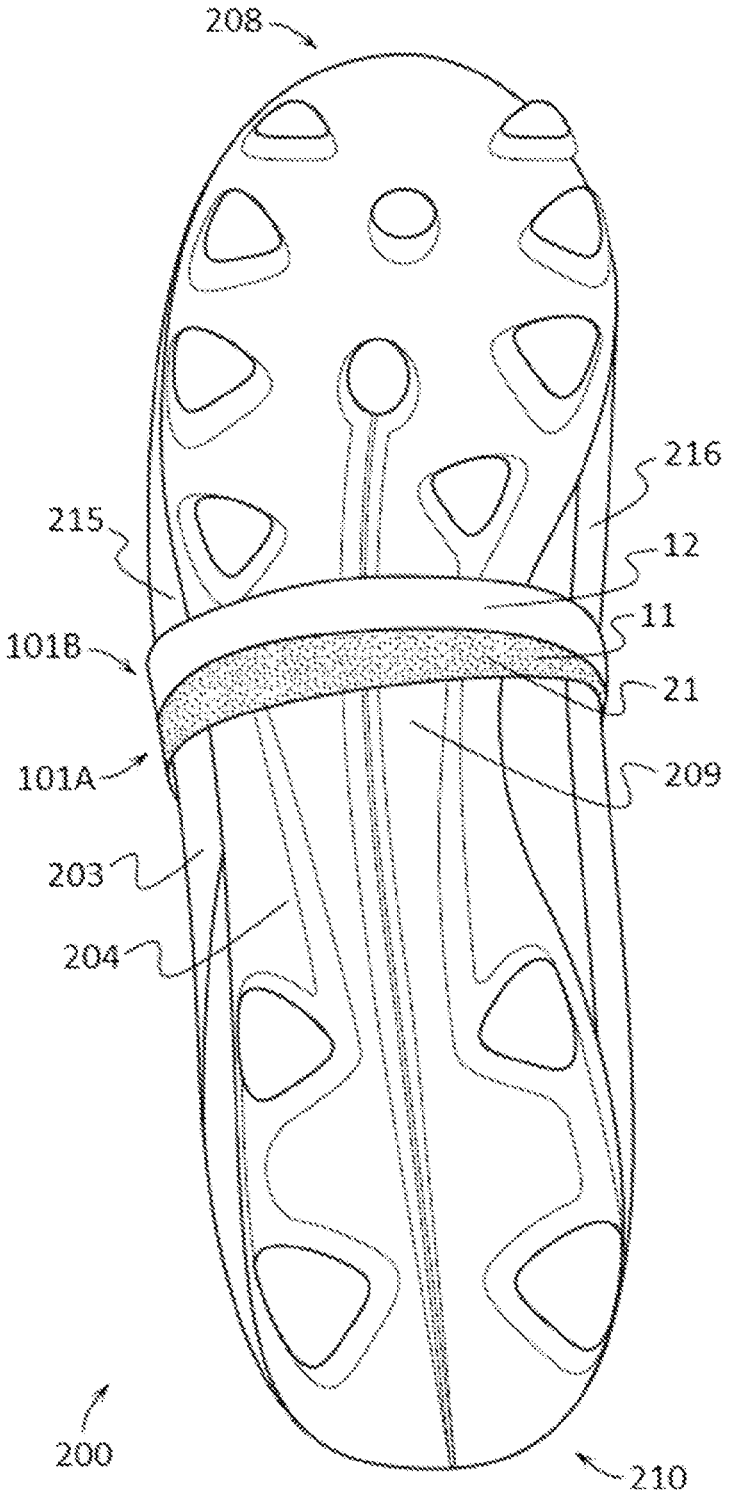
FIG. 5 illustrates a bottom plan view of an example of a tensioned tieless footwear lacing system on an article of footwear according to various embodiments described herein.

Once the first and second tension straps 101A, 101B, may be wrapped around the article of footwear 200 at a position proximate to the midsole region 209, the first and second tension straps 101A, 101B, may be secured to each other such as by securing the first tension strap fastener 21 and the second tension strap fastener 22 together while maintaining the desired tension on the shoe lace 201 as shown in FIGS. 3-5. The tension on the shoe lace 201 may be maintained by the tension strap fasteners 21, 22, as they remain coupled together. Tension on the shoe lace 201 may be relieved by uncoupling the tension strap fasteners 21, 22.

Figure 15:
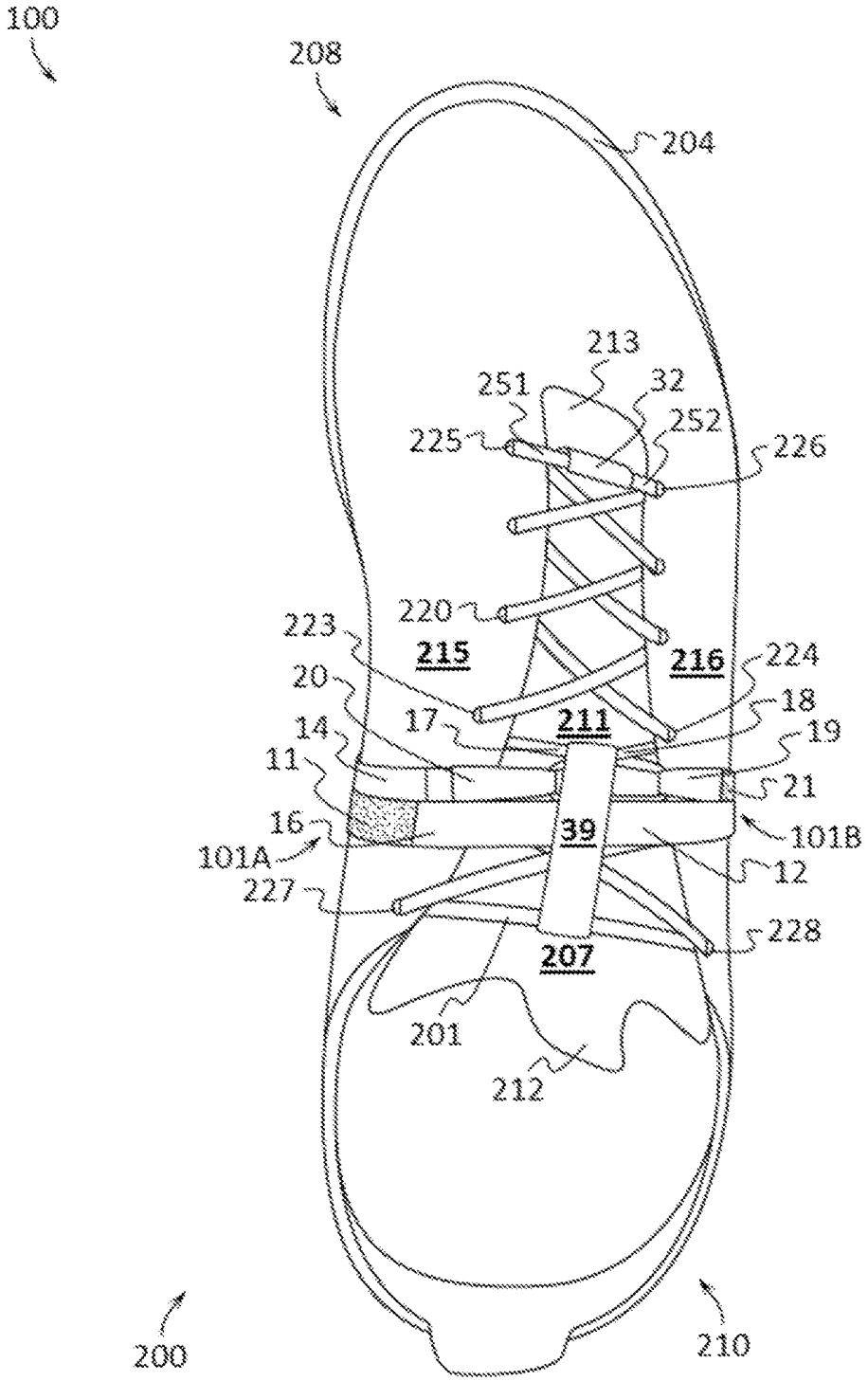
FIG. 15 shows a top plan view of an alternative example of a tensioned tieless footwear lacing system on an article of footwear according to various embodiments described herein.
Figure 16:
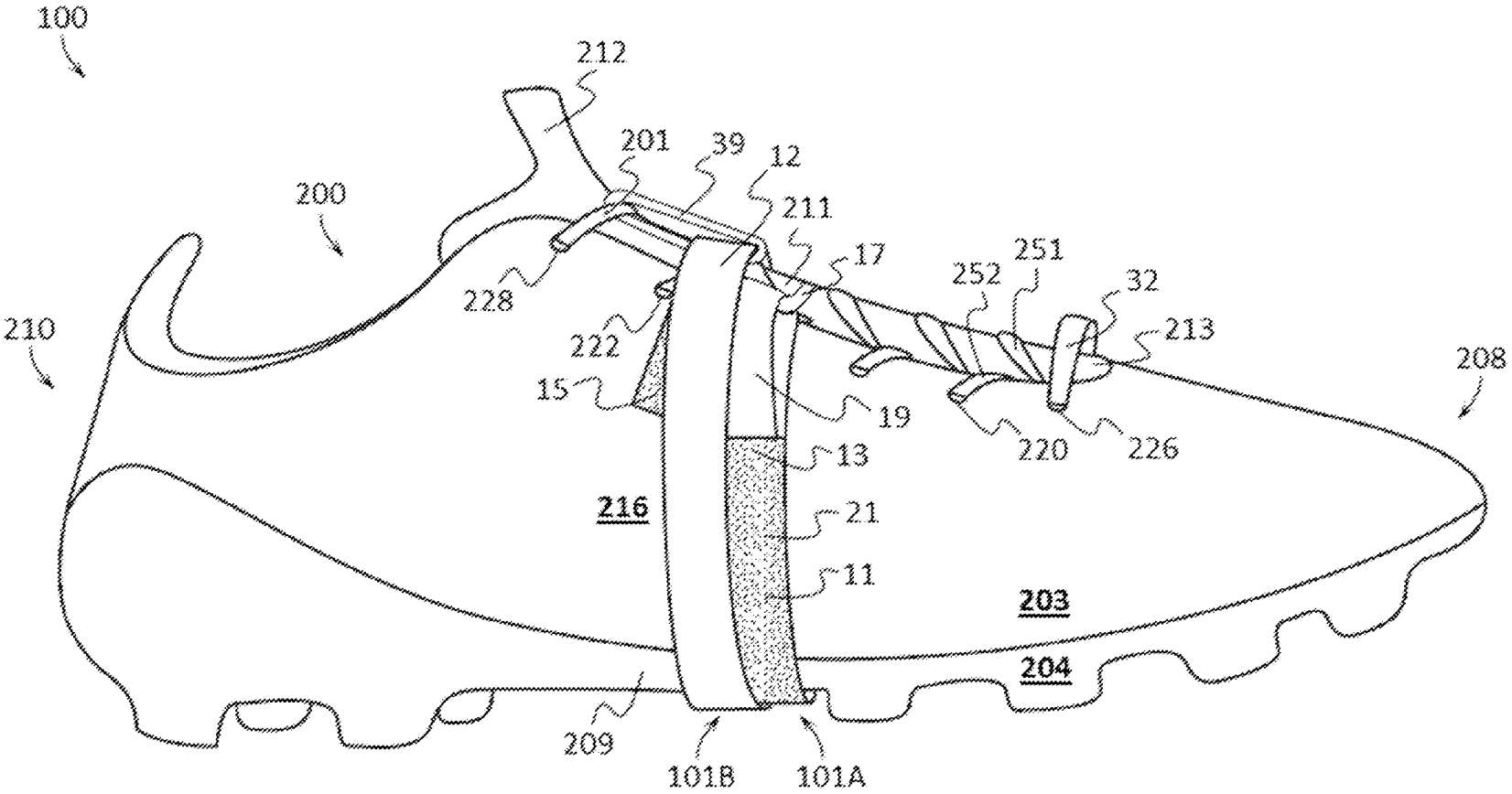
FIG. 16 depicts a side elevation view of an example of a tensioned tieless footwear lacing system on an article of footwear according to various embodiments described herein.

FIG. 15 shows a top plan view and FIG. 16 depicts a side elevation view of an alternative example of a tensioned tieless footwear lacing system 100 on an article of footwear 200 according to various embodiments described herein. In this example, the system 100 may comprise a strap retainer 39 which may be configured to main the positioning of the tension strap apparatuses 101A, 101B, when they have been secured together such as around the midsole region 209 of the article of footwear 200. By preventing the tension strap apparatuses 101A, 101B, from moving towards the toe 208, the tension of the tension strap apparatuses 101A, 101B, may be maintained. In some embodiments, the strap retainer 39 may comprise a loop of flexible material which may wrap around a portion of the shoelace 201 between two eyelets 220, such as the top eyelets 227, 228, and around a portion of the tension strap apparatuses 101A, 101B. In further embodiments, the strap retainer 39 may comprise a length of cotton webbing, nylon webbing, elastic material, and the like, which may be formed into a loop by a fastener, such as a hook and loop type or Velcro® fastener, a button, a magnetic type fastener, a threaded type fastener, a sealable tongue and groove fastener, a snap fastener, a strap type fastener, a buckle type fastener such as a belt or watch buckle type fastener, a clip type fastener, a clasp type fastener, a ratchet type fastener, a push-to-lock type connection method, a turn-to-lock type connection method, slide-to-lock type connection method or any other suitable temporary or removable connection method as one reasonably skilled in the art could envision to serve the same function of configured to temporarily secure two ends of the strap retainer 39 together. In other embodiments, a strap retainer 39 may comprise a carbineer, a clip, or any other type of retainer which is able to temporarily secure the tension strap apparatuses 101A, 101B, to the shoelace 201, shoe tongue 207, eyelet 220, and/or to any other portion of the article of footwear 200.

As shown in FIGS. 1-4, 15, and 16, in some embodiments, the first and second lace bodies 251, 252, of the shoe lace 201 may be laced through the eyelets 220 from the inside direction to the outside direction so that the shoe lace 201 may be generally inside the article of footwear 201 when extending between two top eyelets 227, 228, and generally outside the article of footwear 201 when extending between two bottom eyelets 225, 226. In other embodiments, the first and second lace bodies 251, 252, of the shoe lace 201 may be laced through the eyelets 220 from the outside direction to the inside direction so that the shoe lace 201 may be generally outside the article of footwear 201 when extending between two top eyelets 227, 228, and generally inside the article of footwear 201 when extending between two bottom eyelets 225, 226. In still other embodiments, the first and second lace bodies 251, 252, of the shoe lace 201 may be laced in a pattern or direction through the eyelets 220 selected by the user as it is well known that a user may thread shoe laces 201 in a direction through eyelets 220 either above or below depending on user preference.

Figure 17:
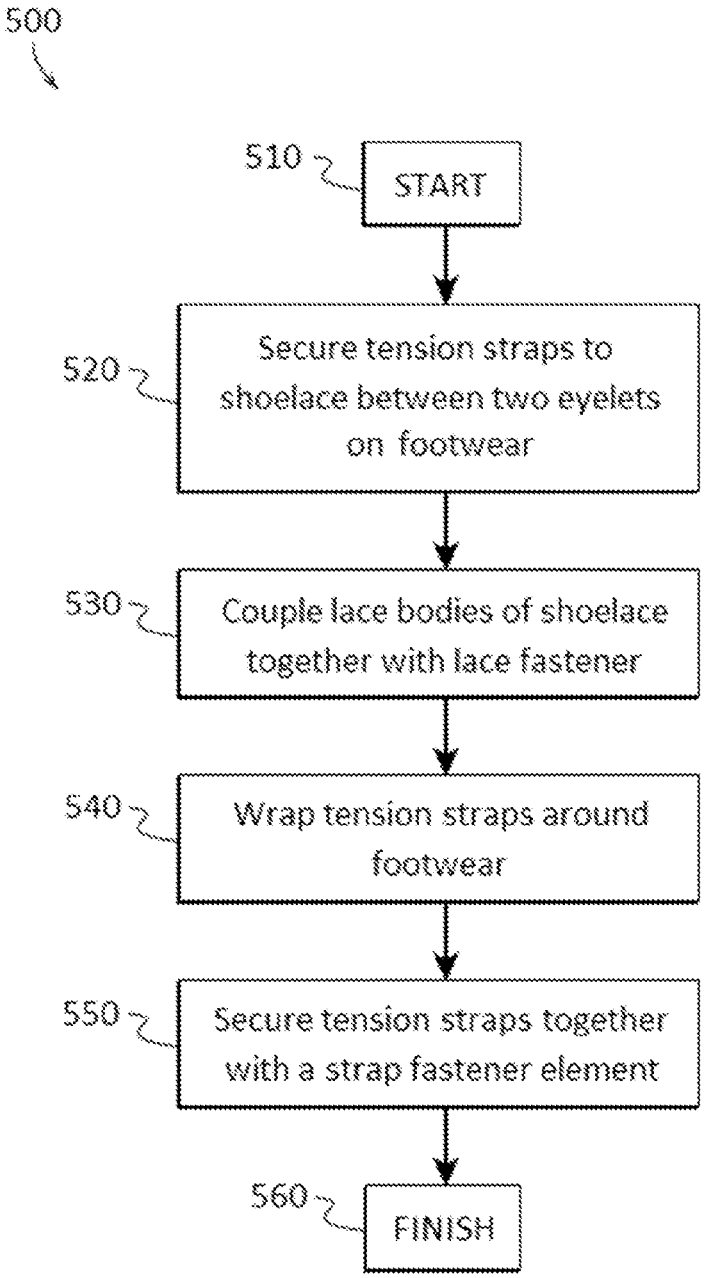
FIG. 17 illustrates a block diagram of an example of a method of securing an article of footwear according to various embodiments described herein.

FIG. 17 shows a block diagram of an example of a method of securing an article of footwear comprising four eyelets and a shoelace ("the method") 500 according to various embodiments described herein. In some embodiments, the method 500 may start 510 and a first and second tensioning strap 101A, 101B, may be secured to the shoelace 201 between two eyelets 220 on the article of footwear 200 in step 520. In further embodiments, the first and second tension straps 101A, 101B, may be coupled to a shoe lace 201 at adjacent locations at opposite sides of a shoe tongue 207 below a set of top eyelets 227, 228, and above a set of bottom eyelets 225, 226. The first medial end 13 may comprise a first lace securing element 19 which may be coupled to the shoe lace 201 of an article of footwear 200, such as to a first lace loop 17 formed by a first portion of a shoe lace 205 located between two shoe eyelets 220 as shown in FIG. 1. The second medial end 14 may comprise a second lace securing element 20 which may be coupled to the shoe lace 201 of an article of footwear 200, such as to a second lace loop 18 formed by a second portion of a shoe lace 206 located between two shoe eyelets 220 as shown in FIG. 1.

In step 530, the first lace body 251 (FIGS. 1, 2, 3, 12-14) and second lace body 252 (FIGS. 1, 2, 3, 12-14) of the shoelace 201 (FIGS. 1, 2, 3, 12-14) may be coupled together with a lace fastener 32, 32A, 32B, 33C, such as at a position proximate to the bottom eyelets 225, 226, (FIGS. 2-4, and 13) to prevent the first lace body 251 and/or the second lace body 252 from pulling through an eyelet 220 such as the bottom eyelets 225, 226, upon tensioning of the shoe lace 201. In some embodiments, the lace fastener 32 (FIGS. 1-4) may comprise a knot type lace fastener 32A (FIG. 12), a buckle type lace fastener 32B (FIG. 13), a clamp type fastener 32C (FIG. 14), or any other fastener suitable for coupling the first lace body 251 and second lace body 252 together.

Next, the first and second tension straps 101A, 101B, may be wrapped around the article of footwear 201 in step 540, optionally, with the desired tension. In some embodiments, the first and second tension straps 101A, 101B, may be configured to wrap around the upper 203 and sole 204 portions of the article of footwear 200 (FIGS. 2,-5) in opposing directions. In further embodiments, the first and second tension straps 101A, 101B, may be wrapped around the article of footwear 200 at a position proximate to the midsole region 209 (FIG. 5).

In step 550, first and second tension straps 101A, 101B, may be secured to one another with a first tension strap fastener 21 (FIGS. 6 and 7) and a second tension strap fastener 22 (FIGS. 9 and 10). In some embodiments, the first and second tension straps 101A, 101B, may be secured to each other around the mid tongue region 211 below the top 212 and bottom 213 of the tongue 207 of the article of footwear 200. In further embodiments, a first and second tension strap fastener 21, 22, may comprise a hook and loop type or Velcro® fastener (FIGS. 1-10), magnetic type fastener, threaded type fastener, sealable tongue and groove fastener, snap fastener, strap type fastener, buckle type fastener such as a belt or watch buckle type fastener, clip type fastener, clasp type fastener, ratchet type fastener, a push-to-lock type connection method, a turn-to-lock type connection method, slide-to-lock type connection method or any other suitable temporary or removable connection method as one reasonably skilled in the art could envision to serve the same function. Finally, the method 500 may finish in step 560.

While some materials have been provided, in other embodiments, the elements that comprise the system 100 such as the first tension strap apparatus 101A, second tension strap apparatus 101B, and/or lace fastener 32 may be made from or comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the system 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the system 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the system 100 may be coupled by being one of connected to and integrally formed with another element of the system 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A footwear lace securing system, the system comprising:

a first tension strap apparatus having a first elongate strap body with a first medial end and a first distal end with said first medial end coupled to a first lace loop formed by a first portion of a shoe lace located between two shoe eyelets;

a second tension strap apparatus having a second elongate strap body with a second medial end and a second distal end with said second medial end coupled to a second lace loop formed by a second portion of the shoe lace located between two shoe eyelets; and wherein both the first and second tension strap apparatuses are configured to wrap around the upper and sole portions of the article of footwear in opposing directions to be secured to one another.

2. The footwear lace securing system of claim 1, wherein the first and second tension strap apparatuses are coupled to a shoe lace at adjacent locations at opposite sides of a shoe tongue below a set of top eyelets and above a set of bottom eyelets.

3. The footwear lace securing system of claim 1, wherein the first and second tension strap apparatuses are wrapped around the article of footwear at a position proximate to the midsole region.

4. The footwear lace securing system of claim 1, wherein the elongate strap bodies of the first and second tension strap apparatuses comprise a tension strap fastener.

5. The footwear lace securing system of claim 4, wherein the tension strap fastener is selected from one of a hook and loop style fastener, a buckle type fastener, and a strap type fastener.

6. The footwear lace securing system of claim 1, wherein the shoelace comprises a first lace body and a second lace body.

7. The footwear lace securing system of claim 6, wherein the first lace body is threaded through a set of eyelets from a first top eyelet to a first bottom eyelet and wherein the second lace body is threaded through a set of eyelets from a second top eyelet to a second bottom eyelet.

8. The footwear lace securing system of claim 7, wherein the first lace body is coupled to the second lace body at a position proximate to the bottom eyelets.

9. The footwear lace securing system of claim 7, wherein the first lace body is coupled to the second lace body at a position proximate to the bottom eyelets with a lace fastener.

10. The footwear lace securing system of claim 9, wherein the lace fastener is selected from one of a knot, a buckle type fastener, and a clamp type fastener.

11. A method of securing an article of footwear comprising four eyelets and a shoelace, the method comprising the steps of:

securing a first tension strap apparatus to the shoelace between two eyelets and securing a second tension strap apparatus to the shoelace between two eyelets on the article of footwear;

coupling lace bodies of the shoelace together with a lace fastener;

wrapping the first and second tensioning strap apparatuses around the article of footwear; and securing the first and second tension strap apparatuses together with a strap fastener element.

12. The method of claim 11, wherein the first and second tension strap apparatuses are coupled to the shoe lace at adjacent locations at opposite sides of a shoe tongue below a set of top eyelets and above a set of bottom eyelets.

13. The method of claim 11, wherein the first and second tension strap apparatuses are wrapped around the article of footwear at a position proximate to the midsole region.

14. The method of claim 11, wherein the first and second tension strap apparatuses each comprise an elongate strap body and a tension strap fastener.

15. The method of claim 14, wherein the tension strap fastener is selected from one of a hook and loop style fastener, a buckle type fastener, and a strap type fastener.

16. The method of claim 15, wherein a first lace body is threaded through a set of eyelets from a first top eyelet to a first bottom eyelet and wherein a second lace body is threaded through a set of eyelets from a second top eyelet to a second bottom eyelet.

17. The method of claim 16, wherein the first lace body is coupled to the second lace body at a position proximate to a bottom eyelet.

18. The method of claim 17, wherein the first lace body is coupled to the second lace body at a position proximate to a bottom eyelet with a lace fastener.

19. The method of claim 18, wherein the lace fastener is selected from one of a knot, a buckle type fastener, and a clamp type fastener.

* * * * *